United States Patent [19]

Corman et al.

[11] Patent Number: 4,801,373

[45] Date of Patent: Jan. 31, 1989

[54] PROCESS OIL MANUFACTURING PROCESS

[75] Inventors: Blaine G. Corman, Crosby; Paul F. Korbach, Baytown; Kenneth M. Webber, Houston, all of Tex.

[73] Assignee: Exxon Research and Engineering Company, Florham Park, N.J.

[21] Appl. No.: 840,882

[22] Filed: Mar. 18, 1986

[51] Int. Cl.[4] ..... C10G 65/04

[52] U.S. Cl. ..... 208/210; 208/DIG. 1; 208/59; 208/89; 208/100

[58] Field of Search ..... 208/89, 210, 100, 14, 208/144, 59; 585/6.6; 252/570

[56] References Cited

U.S. PATENT DOCUMENTS

| | | | |
|---|---|---|---|
| 3,155,608 | 11/1964 | Hopper et al. | 208/89 |
| 3,331,766 | 7/1967 | Young | 208/78 |
| 3,364,133 | 1/1968 | Young et al. | 208/89 |
| 3,481,863 | 12/1969 | Donaldson et al. | 208/210 |
| 3,619,414 | 11/1971 | Mills et al. | 208/14 |
| 3,623,973 | 11/1971 | Tarhan et al. | 208/210 |
| 3,656,911 | 4/1972 | Hobbs | 208/DIG. 1 |
| 3,720,729 | 3/1973 | Sze et al. | 208/57 |
| 3,759,820 | 9/1973 | Boyd | 585/401 |
| 3,912,620 | 10/1975 | Gallagher | 208/210 |
| 3,928,168 | 12/1975 | Mills et al. | 208/14 |
| 4,016,069 | 4/1977 | Christmann | 208/210 |
| 4,022,681 | 5/1977 | Sheng et al. | 208/57 |
| 4,170,543 | 10/1979 | Lipscomb, II et al. | 208/89 |
| 4,175,278 | 11/1979 | Sato et al. | 208/14 |
| 4,243,519 | 1/1981 | Schorfheide | 208/210 |
| 4,260,474 | 4/1981 | Wernicke et al. | 208/87 |
| 4,392,945 | 7/1983 | Howard et al. | 208/210 |
| 4,584,129 | 4/1986 | Katayama | 208/14 |
| 4,608,153 | 8/1986 | Hudson et al. | 208/121 |
| 4,617,110 | 10/1986 | Hindjos et al. | 208/DIG. 1 |
| 4,618,412 | 10/1986 | Hudson et al. | 208/59 |
| 4,619,759 | 10/1986 | Myers et al. | 208/210 |
| 4,629,553 | 12/1986 | Hudson et al. | 208/210 |
| 4,657,663 | 4/1987 | Gardner et al. | 208/210 |

*Primary Examiner*—Anthony McFarlane

*Attorney, Agent, or Firm*—Edward H. Mazer; John W. Ditsler

[57] ABSTRACT

An improved method for producing a hydrotreated oil from a naphthenic feed is described. The process comprises passing the naphthenic feed through the multistage hydrotreating process with intermediate removal of hydrogen sulfide and/or ammonia.

20 Claims, No Drawings

PROCESS OIL MANUFACTURING PROCESS

BACKGROUND AND SUMMARY OF THE INVENTION

The present invention is directed at a hydrotreating process for lube oils. More specifically the present invention is directed at an improved two-stage hydrotreating process for producing process oils from naphthenic feeds utilizing standard hydrotreating catalysts and equipment.

Naphthenic-rich feeds normally have lower wax contents, lower pour points, lower Viscosity Indices and higher ring contents than paraffinic-rich feeds. These properties make it desirable to utilize naphthenic-rich oils as process oil.

Naphthenic feeds, which often are utilized in the manufacture of process oils, frequently contain color bodies and undesirable impurities such as sulfur and basic nitrogen (heteroatom) compounds. The concentration of these compounds must be substantially reduced to meet product specifications. In addition, polynuclear aromatic compounds (PNA) also are present in naphthenic feeds. The concentration of these compounds also must be substantially reduced. The most common method for reducing the concentration of these compounds in lube oils is by contacting the feed with hydrogen in the presence of selected catalysts at elevated temperature and pressure.

Currently, naphthenic process oils are produced by a variety of process schemes including distillation only, distillation followed by mild acid treating and clay percolation or contacting, distillation followed by mild or severe extraction, mild or severe hydrotreating or combinations thereof. The milder processing conditions may produce process oils that are deficient in product composition and/or field performance. Typical measures of product composition are sulfur, basic nitrogen, polars, aromatics, neutralization number, ultraviolet levels of dimethyl sulfoxide extracts and the aniline point. Important product characteristics include compatibility with elastomers and solubility with a range of additives. It has been found that both the crude source and the processing severity affect these properties. Severe processing can drastically reduce product yields to uneconomic levels. The severity of the operating conditions also typically involves an economic balance of equipment availability and cost, yield and desired properties.

Several publications disclose two stage hydrodesulfurization with intermediate product removal. Japanese patent publication No. 71-003267 discloses the production of a highly viscous lubricating oil by passing the oil over a hydrotreating catalyst at 340°-370° C., removing hydrogen sulfide, ammonia and hydrogen followed by passing the product from the first stage through a second stage maintained at a temperature of 200°-340° C. This patent discloses the use of a two stage hydrotreating system operated over different temperature ranges with intermediate removal of hydrogen sulfide, ammonia and hydrogen. The process was utilized to produce a combination of gasoline, middle distillate and only a minor amount of lubricant basestock.

U.S. Pat. No. 3,884,797 discloses a two stage process for pretreatment of naphtha feedstocks prior to reforming to produce gasoline. The first stage comprises a hydrotreating zone operated at 500°-850° F. and at a pressure of 300-3,000 psig. The second stage comprises a hydrosorption zone operated at a temperature of 575°-800° F. and a pressure of 100-800 psig. The product from the hydrosorber is passed directly to a reforming zone operated at a temperature ranging between about 750° F. and 1050° F., preferably between about 850° F. and 1000° F. This process is not especially applicable to the production of lube base-stocks, since, at these conditions significant quantities of the lube feeds would be converted to coke and gas.

East German Pat. No. 59,354 discloses a two stage hydrotreating process in which the first stage hydrotreating is conducted at 350°-450° C. at a pressure of 150-300 atmospheres. After the gaseous products are separated, the second stage hydrotreating is conducted at 300°-400° C. and a pressure of up to about 300 atmospheres. The catalyst in both stages was an oxide or sulfide of Group VI or Group VIII. The use of such a process would not be desirable because of the relatively high pressures utilized. At these pressures, excessive hydrogenation would result in saturate levels and aniline points too high for process oils.

U.S. Pat. No. 3,349,027 also discloses the use of a multi-stage hydrodesulfurization process using typical catalysts with intermediate gas removal. Suitable operating ranges for both stages include the following: temperature 400°-750° F.; pressure 400-700 psig; and hydrogen 200-4,000 SCF/B. This patent does not address the removal of PNA's or maintaining the saturates below predetermined levels.

Other patents disclose two stage hydrotreating processes in which the second stage is operated at a lower pressure than the first stage. For example, UK Pat. No. 1,476,428 discloses a process for the manufacture of white oils, a class of oils having a very low aromatic content. The first stage is operated at a temperature of 300°-425° C., a hydrogen partial pressure of 10-250 bar (140-3600 psig), a space velocity of 0.1-5 kg per liter of catalyst per hour and a hydrogen/feed ratio of 100-5,000 Nl of hydrogen per kg of feed (500-25,000 SCF/B). The second stage treatment may be conducted at a temperature of 175°-325° C. with the ranges of the hydrogen partial pressure, space velocity and hydrogen/feed ratio being similar to those for the first stage. The catalyst for the first stage comprises a sulfided nickel and/or cobalt and molybdenum or nickel and tungsten. The second stage catalyst may be either the same catalyst used in the first stage or noble metal catalysts. The use of such a method for the production of a process oil would not be desirable, since the method would be relatively costly and would result in an almost completely saturated oil.

U.S. Pat. No. 3,928,168 discloses processes for the manufacture of hydrorefined oils under mild (below 800 psig hydrogen) and severe (above 800 psig) hydrotreating conditions to reduce sulfur and nitrogen contents. This patent discloses at column 9 that mild hydrotreating frequently does not significantly alter the polycyclic aromatic content of the oil.

East German Pat. No. 56,885 discloses a two stage hydrotreating process for the production of reformer feeds, diesel oils, household heating fuels and turbine fuels. Conventional hydrotreating catalysts such as cobalt molybdate/alumina, nickel molybdate/alumina or nickel sulfide/tungsten sulfide typically are used for the first and second stages. The first stage is conducted at temperatures of 300°-450° C., a liquid hourly space velocity (LHSV) of 1-10, the hydrogen feed ratio is 100–1,000:1 with a typical first stage pressure being 40 atmospheres. The second stage conditions may be as follows: temperature 200°–370° C., LHSV 0.5–15, and hydrogen/feed 100–1,000:1. A typical pressure also is 40 atmospheres.

U.S. Pat. No. 3,022,245 discloses a two stage hydrotreating process for the production of high quality wax to reduce color and odor. The temperature in the second stage is maintained lower than the temperature in the first stage. The temperature in the first stage typically is maintained between 500° and 650° F., with the temperature in the second stage maintained at least 100° F. lower than the first stage. Pressure in both stages may range between 400 and 1,000 psig. The hydrogen treat rate is 200–750 SCF/B. The feed rates to the first and second stages are 3–5 v/v/hr, and 1–2 v/v/hr, respectively.

U.S. Pat. No. 3,208,931 discloses a two stage process for refining petroleum utilizing conventional hydrotreating catalysts. The patent discloses an example in which the first stage temperature was 750° F. and the second stage temperature was 600° F. The pressure was maintained at 1,000 psig in both stages. Space rates in the first and second stages were 0.3 v/v/hr and 0.49 v/v/hr, respectively, while the gas rates were 2,000 SCF/B and 8,500 SCF/B, respectively.

Other patents which disclose two stage hydrotreating processes include U.S. Pat. Nos. 2,771,401; 3,072,564; 3,089,841; 3,155,608; 3,717,501; 3,208,931; UK Pat. No. 1,546,504; and French Pat. No. 2,073,228.

While it is desirable to hydrogenate polynuclear aromatics, it is desirable to retain mono-aromatic ring compounds, since these mono-aromatic compounds promote improved solubility in the final oil product. To minimize the capital and operating costs of the system, it also is desirable to operate at relatively low pressures and at relatively high throughputs while simultaneously obtaining a high overall product yield. Therefore, the operating conditions which are selected frequently must produce a trade-off in one or more of these properties.

Accordingly, it is desirable to provide a process which is capable of producing a process oil having a relatively large mononuclear aromatics content while having sufficiently reduced polynuclear aromatics, sulfur and nitrogen contents.

It also is desirable to provide a process which is capable of producing a process oil at relatively high yields.

It also is desirable to provide, at moderate pressure, a process which is capable of being utilized in existing hydrotreating equipment.

It also is desirable to provide a process which can be utilized at relatively high throughput rates and at relatively low operating temperatures and pressures.

The present invention is directed at a method for producing a process oil having reduced sulfur, basic nitrogen, and polynuclear aromatics content from a naphthenic feed at relatively high through-put rates while only moderately decreasing the unsaturates content.

The present invention is directed at passing the feed sequentially through a first hydrotreating zone, an intermediate stripping zone and a second hydrotreating zone. The temperature in the second hydrotreating zone is maintained lower than the first hydrotreating zone temperature. The saturates and/or unsaturates content of the product exiting the second hydrotreating zone is monitored. The temperature in the second stage is adjusted and/or the catalyst is regenerated and/or replaced to keep the saturates content and/or the polynuclear aromatics content below predetermined limits.

SUMMARY OF THE INVENTION

A method for producing a process oil having reduced sulfur, nitrogen, and polynuclear aromatics contents from a naphthenic feed containing same and having an atmospheric boiling range of about 650° to about 1200° F., said process comprising:

A. passing the naphthenic feed into a first hydrotreating stage maintained at a temperature of about 600° to about 750° F., and a hydrogen partial pressure of about 400 to about 1,500 psig to convert at least a portion of the sulfur to hydrogen sulfide and the nitrogen to ammonia;

B. passing the hydrotreated feed from the first hydrotreating stage into an intermediate stripping stage wherein hydrogen sulfide and ammonia are removed;

C. passing the hydrotreated feed from the intermediate stage into a second hydrotreating stage maintained at a temperature lower than that of the first stage and at a hydrogen partial pressure ranging between about 400 and about 1,500 psig;

D. monitoring the polynuclear aromatics content and/or the degree of saturation of the product exiting the second hydrotreating stage; and, E. adjusting the temperature in the second hydrotreating stage to keep the polynuclear aromatics and/or the degree of saturation below a predetermined level.

The present invention also is directed at a method for producing a process oil having reduced sulfur, nitrogen, and polynuclear aromatics content from a naphthenic feed containing same and having an atmospheric boiling range of about 650° to about 1200° F. comprising:

A. passing the naphthenic feed into a first hydrotreating stage having hydrotreating catalyst therein, said stage maintained at a temperature of about 600° to about 750° F., and a hydrogen partial pressure of about 400 to about 1,500 psig to convert at least a portion of the sulfur to hydrogen sulfide, the nitrogen to ammonia and to reduce the polynuclear aromatics content;

B. passing the hydrotreated feed from the first hydrotreating stage into an intermediate stripping stage wherein hydrogen sulfide and ammonia are removed;

C. passing the hydrotreated feed from the intermediate stage into a second hydrotreating stage having hydrotreating catalyst therein, said second hydrotreating stage maintained at a temperature lower than that of the first hydrotreating stage and at a hydrogen partial pressure ranging between about 400 and about 1,500 psig;

D. monitoring the polynuclear aromatics content and/or the degree of saturation of the product exiting the second hydrotreating stage; and, E. regenerating and/or replacing hydrotreating catalyst when the polynuclear aromatics content and/or the degree of saturation of the product exiting the second hydrotreating stage exceeds a predetermined value.

The temperature of the first hydrotreating stage preferably is maintained within the range of about 630° to about 720° F., more preferably within the range of about 650° to about 700° F. The temperature of the second hydrotreating stage preferably is maintained within the range of about 550° to about 650° F., more preferably within the range of about 570° to about 600° F. In the intermediate stripping stage hydrogen sulfide and/or ammonia is removed from the hydrotreated material exiting from the first stage by contacting said material with a stripping agent selected from the group consisting of steam, inert gas, and mixtures thereof. A particularly preferred stripping agent is steam. The catalysts utilized in both the first and second hydrotreating stages may be conventional hydrotreating catalysts, with nickel-molybdenum and cobalt-molybdenum being particularly preferred. Catalyst having the same or similar composition may be utilized in the first and second hydrotreating stages. The process oil produced by the above-noted process preferably has a maximum saturate content of about 80 wt.% (e.g., a saturates content below about 80 wt. %), more preferably a maximum saturates content of about 75 wt.% (e.g., a saturates content below about 75 wt. %). However, with extremely naphthenic crudes, i.e. crudes having a viscosity gravity constant of 0.82 or greater on the saturates fraction, a higher maximum saturates content could be utilized.

The polynuclear aromatics content of the finished process oil preferably is maintained below about 100 ppm. The polynuclear aromatics content of the process oil typically is reduced to no more than about ⅓ and preferably to less than ⅓ of the PNA content of the naphthenic feed. The aromatics content of the finished process oil preferably is reduced by less than 8 wt.% by the subject process. The hydrogen partial pressure preferably is within the range of 400 to about 1500 psig, more preferably within the range of about 550 to about 800 psig.

The overall liquid hourly space velocity preferably ranges between about 0.1 and about 4.0, more preferably within the range of about 0.25 and 2.0.

The hydrogen treat typically ranges between about 350 and about 3,000 SCF/B, more typically within the range of about 450 and about 1,500 SCF/B.

DETAILED DESCRIPTION OF THE INVENTION

The feed utilized in the present invention typically will comprise a naphthenic-rich feed from a distillation process, although other feeds such as mildly solvent extracted, extracted or solvent dewaxed paraffinic feedstocks also have been and may be utilized. The multistage hydrotreating process with intermediate product removal discussed below comprises a first stage hydrotreating process, an intermediate product removal stage and a second hydrotreating stage following the intermediate product removal stage. However, it is within the contemplation of the present invention that additional stages could be utilized for either hydrotreating and/or product removal.

The first hydrotreating stage comprises a pressure vessel having a hydrotreating catalyst therein. Hydrotreating catalysts are well-known in the art. Such catalysts include nickel-molybdenum, cobalt-molybdenum, nickel-tungsten, trimetallic nickel, cobalt, molybdenum and mixtures thereof. The first hydrotreating stage is maintained at a temperature ranging between above 600° F. and about 750° F., preferably within the range of about 630° F. and about 720° F., and more preferably within the range of about 650° F. and about 700° F. Utilizing higher temperatures may adversely affect the overall yield of product and may even result in the production of PNA's, while the use of temperatures below those set forth herein above may result in unacceptably slow hydrotreating rates and/or poorer product quality. The liquid hourly space velocity (LHSV) preferably ranges between about 0.1 and about 4.0, more preferably within the range of about 0.25 and about 2.0. The overall yield of process oil preferably is maintained within the range of about 85 to about 100 wt.% of the entering feed, preferably within the range of about 90 to about 96 wt.% The hydrogen partial pressure in the first hydrotreating stage may range between about 400 and about 1,500 psig, preferably between about 550 and about 800 psig. The hydrogen treat rate preferably ranges between about 350 and about 3,000 SCF/B, more preferably within the range of about 450 and about 1,500 SCF/B.

The conditions in the second stage may be similar to those in the first stage with the exception of the temperature. At equal pressures, the temperature in the second hydrotreating stage should be lower than that of the first hydrotreating stage and preferably should be maintained within the range of about 400° and about 680° F., more preferably within the range of about 575° and about 600° F. While the other parameters, i.e. catalysts, LHSV, hydrogen treat and pressure may be similar to those of the first hydrotreating stage, it has been found that the temperature in the second hydrotreating stage may be optimized for the feed, pressure, rate and gas treat rate used to provide a desirable balance of total saturation with partial saturation of polynuclear aromatics.

The catalyst used is not critical. However use of catalyst having excessively high activity may result in an undesirably high increase in the total saturates level of the final product. Among the most preferred catalysts are nickel-molybdenum sulfides, cobalt-molybdenum sulfides, cobalt-molybdenum-nickel sulfides, and nickel-tungsten sulfides.

The particular pressure utilized preferably is a function of several factors including pressure rating of the equipment, available hydrogen pressure, desired throughput rates, desired degree of saturation, catalyst utilized and feedstock being treated.

An essential step in the present invention is the intermediate removal of hydrogen sulfide and/or ammonia between the first and second hydrotreating stages. These compounds may be removed from the hydrotreated feed exiting the first stage by passing the hydrotreated feed through a contacting vessel having a solvent or absorbent medium that is selectively miscible and/or reactive with the hydrogen sulfide and/or ammonia present. One method for removing the sulfur and/or ammonia is by passing the hydrotreated feed through a stripping vessel having steam, $CO_2$ or an inert gas, such as nitrogen, or mixtures thereof present. A particularly preferred stripping agent is saturated steam. The use of steam to strip hydrogen sulfide and/or ammonia from process oil is well known in the art. The pressure in the intermediate stripping zone can be maintained over a wide range depending in part on repressurization economics and desired degree of sulfur removal.

Utilization of the present invention permits the production of a process oil having reduced sulfur, nitrogen and PNA contents at acceptable saturation levels. The degree of saturation typically is determined by the rise in the aniline point utilizing the test procedure described in ASTM test D-611, the disclosure of which incorporated herein by reference. Since the solubility of the process oil is somewhat inversely related to the degree of saturation, a rise in the aniline point generally indicates that the solubility properties of the oil have been reduced.

One method for determining the PNA level in the product is by extracting the process oil with a solvent such as dimethyl sulfoxide (DMSO) and passing ultraviolet light through the extract. This test is disclosed in ASTM D-2269-83, the disclosure of which is incorporated herein by reference. The absorbance at each wavelength is proportional to the concentration of unsaturated aromatics resonating in that wavelength range. Thus, in general, the lower the absorbance at a particular wavelength, the lower the concentration of mononuclear aromatics and/or polynuclear aromatics.

The present invention is of particular utility in producing a process oil having acceptable maximum saturates and/or PNA contents. In a preferred embodiment, both the saturates and PNA contents are monitored and the temperature in the second hydrotreating stage adjusted to maintain both below the predetermined maximum levels.

Since the catalyst employed in the first and second hydrotreating stages may become inactivated over time, resulting in undesirably high PNA contents in the process oil, the present invention also is directed at monitoring the PNA content of the process oil and regenerating and/or replacing the catalyst when the PNA content exceeds a predetermined value.

As shown by the following Comparative Examples and Examples, the present invention has been found to produce a process oil having substantially reduced sulfur, basic nitrogen and PNA contents at acceptable yields and at acceptable through-put rates. The oils produced by the subject invention also had a relatively low saturates content and an acceptable solubility as determined by the aniline point rise.

COMPARATIVE EXAMPLE I

In this Comparative Example, a naphthenic feedstock was passed through a single hydrotreating zone at an LHSV of 0.35. The temperature was maintained at about 630° F., the pressure about 800 psig, partial pressures of hydrogen, the hydrogen treat rate at about 450 SCF/B in the presence of a nickel-molybdenum catalyst. The sulfur content was reduced from 1.07% to about 0.17%.

EXAMPLE

In this Example, the naphthenic feed utilized in Comparative Example I was utilized in a two stage hydrotreating process with intermediate removal of hydrogen sulfide and ammonia. The temperature in the first hydrotreating stage was maintained at approximately 671° F. The hydrogen partial pressure was maintained at about 550 psig, the LHSV was maintained at about 1, and the hydrogen treat rate was maintained at about 450 SCF/B. The hydrotreated feed exiting from the first hydrotreating vessel was passed to an intermediate stripping zone in which hydrogen sulfide and ammonia were stripped from the hydrotreated feed. The hydrotreated material after steam stripping was passed through a second stage hydrotreating vessel maintained at a temperature of about 572° F., a hydrogen partial pressure of about 550 psig, an LHSV of about 1 and a hydrogen treat rate of about 450 SCF/B. The catalysts utilized in the second stage was the same as that utilized in the first stage, a nickel-molybdenum catalyst. The process oil produced by this process had superior properties to that produced by Comparative Example I. In this process, the residual sulfur content of the process oil was only about 0.02 wt.%. The PNA's were significantly reduced as compared with the single stage hydrotreating process, while the aniline point was substantially the same as that of the process oil produced in the single stage process. The overall yield was approximately 90 wt%. Thus, the process described in this example was able to produce a process oil having an aromatics content substantially similar to that of Comparative Example I while at the same time having reduced the undesired sulfur, basic nitrogen and PNA contents to acceptable limits.

The process of Example I had a surprisingly high overall LHSV of 0.5 per stage, whereas in Comparative Example I the single stage had an LHSV of only 0.35.

Thus, it was possible to significantly reduce the undesired feed components without a significant reduction in the desired solubility and compatability properties of the product. A summary of certain key operating parameters and process oil properties for the naphthenic feed, the process oil of Comparative Example I and Example I is presented below.

TABLE I

| | Naphthenic Feed | Comp. e.g. I Single Stage Hydrotreating | Example I Two Stage Hydrotreating |
|---|---|---|---|
| LHSV | — | 0.35 | 0.5 |
| Temp., °F. | — | 630 | 671/572 |
| SCF/Bbl | — | 450 | 450 |
| Psig, $H_2$ | — | 800 | 550 |
| Aniline Pt., °F. | 166.2 | 180.5 | 180.5 |
| Saturates, wt. % | 54.7 | 61.8 | 63.0 |
| Sulfur, wt. % | 1.07 | 0.17 | 0.02 |
| Basic N, ppm | 210.5 | 56.6 | 105.4 |
| DMSO-UV Abs/cm | | | |
| 280–289 nm | 1164 | 402.1 | 222.2 |
| 290–299 nm | 1368 | 376.3 | 170.6 |
| 300–360 | 1109 | 305.8 | 136.7 |
| 360–400 | 124 | 21.4 | 8.8 |

COMPARATIVE EXAMPLE II

This Comparative Example demonstrates the criticality in removing hydrogen sulfide and/or ammonia intermediate the first and second hydrotreating stages. In this Comparative Example, there was not intermediate removal of the hydrogen sulfide and/or ammonia compounds present. The temperature of the first hydrotreating stage was maintained at about 670° to 680° F. The hydrogen partial pressure was maintained at about 550 psig. The LHSV was maintained at about 1 and the hydrogen treat rate was maintained at about 450 SCF/B in both stages. The catalyst utilized in the first stage was a nickel-molybdenum catalyst similar to, but not identical to that used in Comparative Example I and Example I. The hydrotreated material exiting the first stage, was passed into a second hydrotreating stage maintained at a temperature of about 575° to about 600° F. All other conditions in the second hydrotreating vessel, i.e. pressure, LHSV and catalysts were similar to those in the first hydrotreating stage. The overall yield from the hydrotreating process was approximately 91 wt.%.

EXAMPLE II

In this example, the equipment and catalyst used were the same as that employed in Comparative Example II. The processing conditions also were similar to those of Comparative Example II, but with removal of hydrogen sulfide, ammonia and hydrogen between the first and second hydrotreating stages. The overall yield was about 95.1–95.7 wt.%. Key operating parameters and properties of the process oil produced in Comparative Example II and Example II are set forth in Table II below.

TABLE II

| | Comp. e.g. II No Intermediate Stripping or Fresh Gas | Example II Intermediate Stripping |
|---|---|---|
| Liquid Yield, wt. % | 95.8 | 95.1–95.7 |
| Aniline Point, °F. | 180.0 | 179.0 |
| Saturates, wt. % | 60.2 | 61.0 |
| Sulfur, wt. % | 0.090 | 0.05 |
| DMSO-UV Abs/cm | | |
| 280–289 nm | 527.4 | 361.6 |
| 290–299 nm | 517.9 | 381.6 |
| 300–359 nm | 421.3 | 308.5 |
| 360–400 nm | 24.8 | 2.8 |
| LHSV Overall | 0.5 | 0.5 |
| Temp., | | |
| Stage 1, °F. | 355 | 355 |
| Stage 2, °F. | 310 | 310 |
| SCF/Bbl | 450 | 450 |
| Psig $H_2$ | 550 | 550 |

Thus, from a comparison of Comparative Example II and Example II it may be seen that at substantially similar aniline points, intermediate stripping and fresh hydrogen addition resulted in a significant reduction in the PNA and sulfur contents of the process oil.

What is claimed is:

1. A method for producing a naphthenic process oil having reduced sulfur, nitrogen and polynuclear aromatics contents from a naphthenic feed containing same and having an atmospheric boiling range of about 650° to about 1200° F. comprising:

A. passing the feed into a first hydrotreating stage having a hydrotreating catalyst therein, said stage maintained at a temperature of about 600° to about 750° F. and at a hydrogen partial pressure of about 400 to about 1500 psig, to convert at least a portion of the sulfur to hydrogen sulfide and the nitrogen to ammonia;

B. passing the hydrotreated feed from the first hydrotreating stage into an intermediate stripping stage wherein hydrogen sulfide, ammonia, or both is removed;

C. passing the hydrotreated feed from the intermediate stage into a second hydrotreating stage having therein a hydrotreating catalyst selected from the group consisting of nickel-molybdenum, cobalt-molybdenum, nickel-tungsten and mixtures thereof, said second hydrotreating stage maintained at a temperature lower than that of the first hydrotreating stage and at a hydrogen partial pressure ranging between about 400 and about 1,500 psig;

D. monitoring the polynuclear aromatics content, the degree of saturation, or both of the product exiting the second hydrotreating stage; and, E. adjusting the temperature in the second hydrotreating stage to keep the polynuclear aromatics content, the degree of saturation, or both below a limit suitable for process oil.

2. The method of claim 1 wherein the temperature of the first hydrotreating stage ranges between about 630° and about 720° F.

3. The method of claim 2 wherein the temperature of the first hydrotreating stage ranges between about 650° and about 700° F.

4. The method of claim 2 wherein the temperature of the second hydrotreating stage ranges between about 550° and about 650° F.

5. The method of claim 4 wherein the temperature of the second hydrotreating stage ranges between about 570° and about 600° F.

6. The method of claim 4 wherein the hydrogen partial pressure in the first and second hydrotreating stages ranges between about 550 and about 800 psig.

7. The method of claim 4 wherein hydrogen sulfide and ammonia are removed in the intermediate stripping stage by contacting the hydrotreated material exiting from the first stage with a stripping agent selected from the group consisting of steam, inert gas and mixtures thereof.

8. The method of claim 7 wherein the stripping agent comprises saturated steam.

9. The method of claim 6 wherein the catalyst utilized in the first hydrotreating stage is selected from the group consisting of nickel-molybdenum, cobalt-molybdenum, nickel-tungsten and mixtures thereof.

10. The method of claim 1 wherein the temperature in said second hydrotreating stage is adjusted to keep the saturates content of the product exiting the said second stage below about 80 weight percent of said product.

11. The method of claim 10 wherein said temperature in the second stage is adjusted to keep the saturates content of the product exiting said second stage below about 75 weight percent of said product.

12. The method of claim 10 wherein the temperature is adjusted to keep the aromatics content of the products exiting said second stage below about 100 parts per million.

13. The method of claim 9 wherein the catalyst utilized in the first hydrotreating stage has the same composition as the catalyst utilized in said second hydrotreating stage.

14. A method for producing a naphthenic process oil having reduced sulfur, nitrogen and polynuclear aromatics contents from a naphthenic feed containing same and having an atmospheric boiling range of about 650° to about 1200° F. comprising:

A. passing the feed into a first hydrotreating stage having a catalyst therein, said stage maintained at a temperature of about 650° to about 700° F. and a hydrogen partial pressure of about 550 to about 800 psig to convert at least a portion of the sulfur to hydrogen sulfide and the nitrogen to ammonia;

B. passing the hydrotreated feed from the first hydrotreating stage into an intermediate stripping stage wherein hydrogen sulfide and ammonia are removed;

C. passing the hydrotreated feed from the intermediate stage into a second hydrotreating stage having a catalyst selected from the group consisting of nickel-molybdenum, cobalt-molybdenum, nickel-tungsten and mixtures thereof, said second hydrotreating stage maintained at a temperature within the range of about 570° to about 600° F. and at a hydrogen partial pressure ranging between about 550 and about 800 psig;

D. monitoring the polynuclear aromatics content and degrees of saturation of the product exiting the second hydrotreating stage; and, E. adjusting the temperature in the second hydrotreating stage to keep the polynuclear aromatics content below about ⅓ of the polynuclear aromatics content of the naphthenic feed and the degree of saturation below about 80 wt.%.

15. The method of claim 14 wherein the catalyst utilized in the first hydrotreating stage has the same composition as the catalyst utilized in said second hydrotreating stage.

16. The method of claim 14 wherein hydrogen sulfide and ammonia are removed in the intermediate stripping stage by contacting the hydrotreated material exiting from the first stage with a stripping agent selected from the group consisting of steam, inert gas and mixtures thereof.

17. The method of claim 16 wherein the stripping agent comprises saturated steam.

18. The method of claim 16 wherein the catalyst utilized in the first hydrotreating stage has the same composition as the catalyst utilized in said second hydrotreating stage.

19. The method of claim 16 wherein the temperature in said second stage is adjusted to keep the saturates content of the product exiting the second stage below about 75 weight percent of said product.

20. The method of claim 19 wherein the temperature is adjusted to keep the aromatics content of the products exiting the said second stage below about 100 parts per million.

* * * * *